US009101226B1

(12) United States Patent
Hartenstine et al.

(10) Patent No.: US 9,101,226 B1
(45) Date of Patent: Aug. 11, 2015

(54) INFANT SUPPORTING APPARATUS

(71) Applicant: WONDERLAND NURSERYGOODS COMPANY LIMITED, Central Hong Kong (HK)

(72) Inventors: Curtis M. Hartenstine, Birdsboro, PA (US); Andrew J. R. Horst, West Lawn, PA (US); Ryan N. Miller, Lancaster, PA (US); William B. Bellows, Wyomissing, PA (US); Daniel A. Sack, Pottstown, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 0 days.

(21) Appl. No.: 14/167,385

(22) Filed: Jan. 29, 2014

Related U.S. Application Data

(60) Provisional application No. 61/849,566, filed on Jan. 29, 2013, provisional application No. 61/854,510, filed on Apr. 25, 2013.

(51) Int. Cl.

| | |
|---|---|
| ***A47D 13/00*** | (2006.01) |
| ***A47D 9/00*** | (2006.01) |
| ***A47D 7/00*** | (2006.01) |
| ***A47D 7/01*** | (2006.01) |
| ***A47D 13/06*** | (2006.01) |

(52) U.S. Cl.
CPC .. *A47D 9/00* (2013.01); *A47D 7/00* (2013.01); *A47D 7/01* (2013.01); *A47D 13/06* (2013.01)

(58) Field of Classification Search
CPC ..... A47D 7/00; A47D 13/00
USPC ..... 5/2.1, 8, 9.1, 93.1, 93.2, 95
See application file for complete search history.

(56) References Cited

U.S. PATENT DOCUMENTS

| | | | | |
|---|---|---|---|---|
| 2005/0150053 | A1* | 7/2005 | Hartenstine | 5/655 |
| 2012/0110730 | A1* | 5/2012 | Sousa et al. | 5/2.1 |

* cited by examiner

*Primary Examiner* — Fredrick Conley
(74) *Attorney, Agent, or Firm* — David I. Roche; Baker & McKenzie LLP

(57) ABSTRACT

An infant supporting apparatus includes a leg frame defining a clearance and having foot portions configured to stand on a ground surface, a support frame assembled with the leg frame above the foot portions, and an infant resting support for receiving the placement of a child, the infant resting support being suspended from the support frame above the clearance. The infant supporting apparatus has a configuration of use in which the infant supporting apparatus has the leg frame standing on a ground adjacent to a play yard that is received at least partially through the clearance, the infant resting support being suspended from above the play yard and the infant supporting apparatus being attached with the play yard. Moreover, the infant supporting apparatus can be independently used as a standalone device separate from the play yard.

28 Claims, 13 Drawing Sheets

INFANT SUPPORTING APPARATUS

CROSS-REFERENCE TO RELATED APPLICATIONS

This application claims priority to U.S. Provisional Patent Application No. 61/849,566 filed on Jan. 29, 2013; and to U.S. Provisional Patent Application No. 61/854,510 filed on Apr. 25, 2013, both of which are incorporated herein by reference.

BACKGROUND

1. Field of the Invention

The present invention relates to infant supporting apparatuses that can be used in combination with a play yard.

2. Description of the Related Art

Portable play yards currently available on the market are usually sold with a variety of accessories such as a removable diaper changing station, napper station and bassinet. Unfortunately, these accessories are conventionally designed to be attached to the top rails of the play yard. Because the top rails offer a limited space for attachment, it may be difficult to use all of the accessories at the same time. For example, both the napper station and diaper changing station usually make it impossible to use the bassinet in the play yard. Moreover, the conventional design of the aforementioned accessories does not allow to use them independently as standalone devices.

Therefore, there is a need for infant supporting apparatuses that are more versatile in use, and can address at least the foregoing issues.

SUMMARY

The present application describes an infant supporting apparatus. The infant supporting apparatus includes a leg frame defining a clearance and having foot portions configured to provide support on a ground surface, a support frame connected with the leg frame above the foot portions, an infant resting support for receiving the placement of a child, the infant resting support being suspended from the support frame above the clearance, and a latching structure configured to engage with a play yard to attach the infant supporting apparatus with the play yard.

In other embodiments, the infant supporting apparatus includes a leg frame defining a clearance and having foot portions configured to stand on a ground surface, a support frame assembled with the leg frame above the foot portions, and an infant resting support for receiving the placement of a child, the infant resting support being suspended from the support frame above the clearance. The infant supporting apparatus has a configuration of use in which the infant supporting apparatus has the leg frame standing on a ground adjacent to a play yard that is received at least partially through the clearance, the infant resting support being suspended from above the play yard and the infant supporting apparatus being attached with the play yard.

DETAILED DESCRIPTION OF THE EMBODIMENTS

Figure 1:
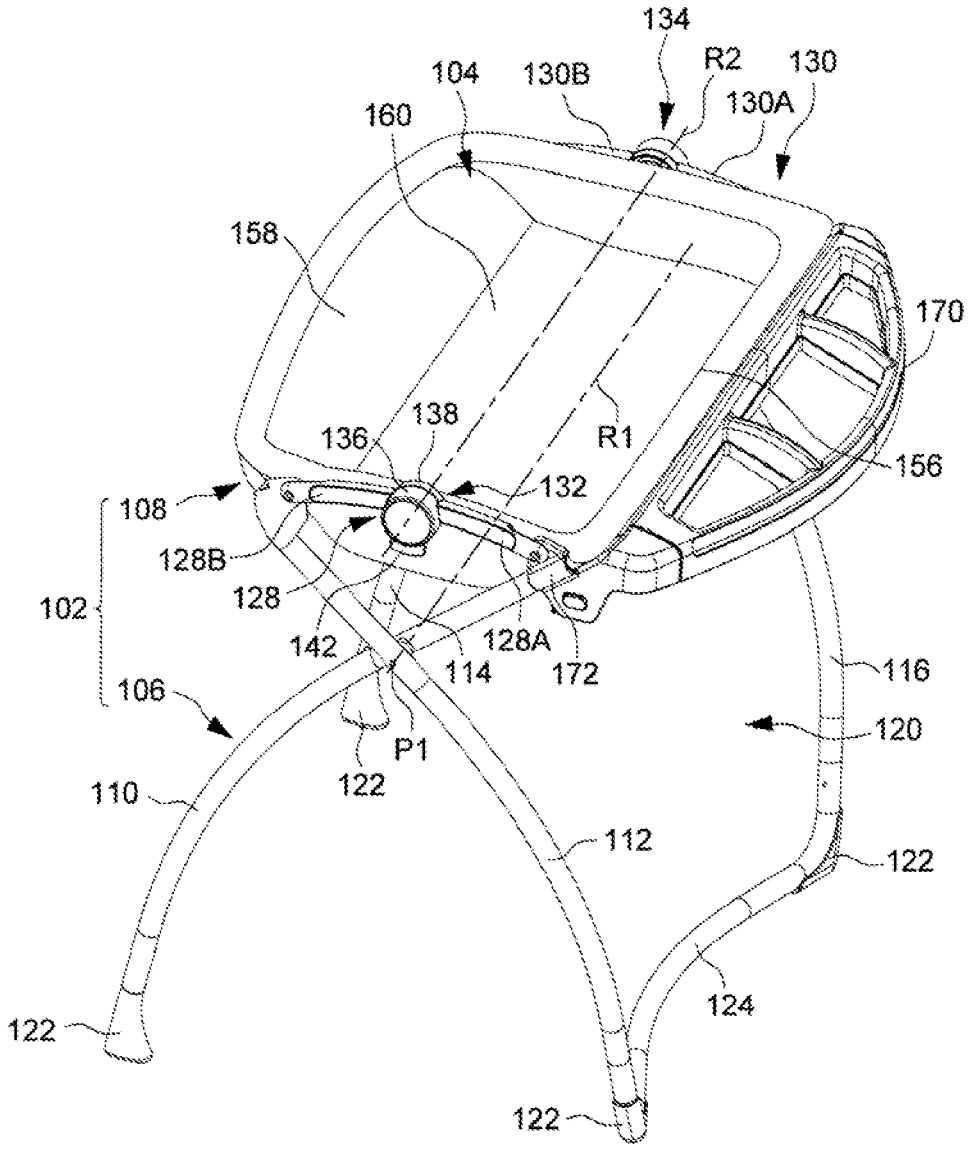
FIG. 1 is a schematic view illustrating an embodiment of an infant supporting apparatus.

FIG. 1 is a perspective view illustrating one embodiment of an infant supporting apparatus 100. The infant supporting apparatus 100 can include a frame structure 102, and an infant resting support 104 coupled with the frame structure 102. The frame structure 102 can include a leg frame 106, and a support frame 108 connected with an upper portion of the leg frame 106. The leg frame 106 can stand on a ground surface, and the infant resting support 104 can be suspended from the support frame 108 to receive the placement of a child thereon.

The leg frame 106 can include a plurality of legs 110, 112, 114, 116, each of which can be formed by one or more tube segment. The leg 110 can be pivotally connected with the leg 112 via a pivot link P1 at a first side of the leg frame 106, and the leg 114 can be pivotally connected with the leg 116 via a pivot link P2 at a second side of the leg frame 106, the pivot links P1 and P2 having a same pivot axis R1, and the legs 110 and 112 being spaced apart from the legs 114 and 116 along the pivot axis R1.

The legs 110 and 114 can be pivoted about the pivot axis R1 toward the legs 112 and 116 to collapse the leg frame 106, and away from the legs 112 and 116 to deploy the leg frame 106 for standing on a ground. The lower portions of the legs 110, 112, 114, 116 can form foot portions 122 that can rest against a ground surface. For improving stability, a cross bar 124 can be connected with downward portions of the legs 112 and 116 to provide rigidity to the leg frame 106. When the leg frame 106 is deployed for use, a clearance 120 can be defined between the legs 110 and 112 at the first side of the leg frame 106, and the legs 114 and 116 at the second side of the leg frame 106. The clearance 120 can vertically extend from the level of the foot portions 122 to the infant resting support 104.

The leg frame 106 can further include two pivotal linkages 128 and 130 respectively assembled between the legs 110 and 112 and between the legs 114 and 116. The pivotal linkage 128 can include two linkage segments 128A and 128B, the distal ends of the linkage segments 128A and 128B being respectively connected pivotally with the legs 110 and 112, and the proximal ends of the linkage segments 128A and 128B being pivotally connected with each other via a pivot joint 132 that is located above the pivot axis R1. Likewise, the pivotal linkage 130 can include two linkage segments 130A and 130B, the distal ends of the linkage segments 130A and 130B being respectively connected pivotally with the legs 114 and 116, and the proximal ends of the linkage segments 130A and 130B being pivotally connected with each other via a pivot joint 134 that is located above the pivot axis R1. The two pivot joints 132 and 134 can define a same pivot axis R2 parallel to and above the pivot axis R1.

One or two of the pivot joints 132 and 134 can include a lock mechanism operable to lock the frame structure 102 (including the leg frame 106 and the support frame 108) in the deployed state. For example, the pivot joint 132 can include two hub housings 136 and 138 that are respectively affixed with the linkage segments 128A and 128B and are pivotally connected with each other, and a release actuator 142 assembled through the hub housings 136 and 138 and operatively connected with an inner latch (not shown). The pivot joint 134 may have a structure similar to the pivot joint 132. When the leg frame 106 is in the deployed state, the pivot joint 132 is located above the pivot axis R1, and the inner latch can engage with an inner socket (not shown) to prevent rotation of the linkage segment 128A relative to the linkage segment 128B such that the leg frame 106 can be locked in the deployed state.

The release actuator 142 can be operated to cause the inner latch to unlock and allow rotation of the linkage segment 128A relative to the linkage segment 128B. The legs 110 and 114 can then be rotated about the pivot axis R1 to collapse toward the legs 112 and 116, which causes the pivot joints 130 and 132 to move upward and the linkage segments 128A and 128B and the linkage segments 130A and 130B to fold toward each other about the pivot axis R2.

Figure 2:
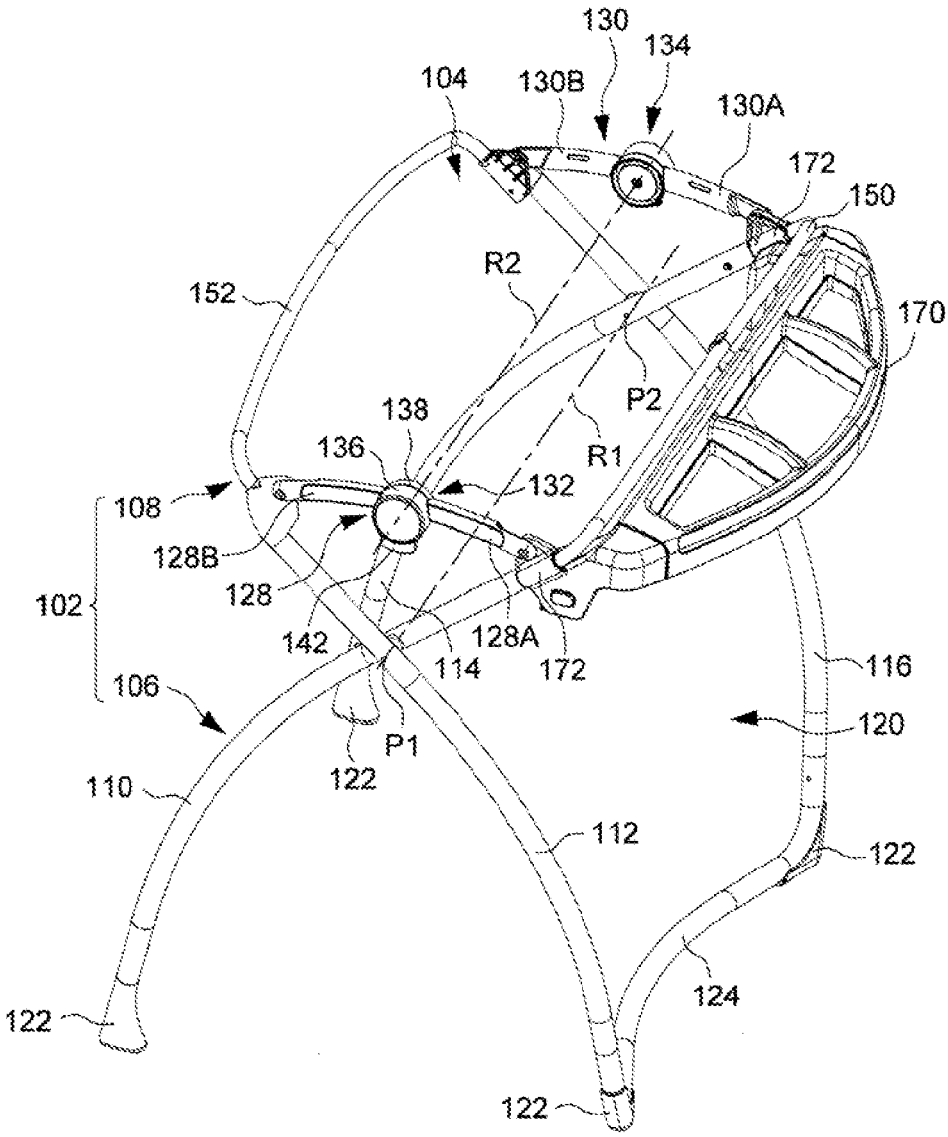
FIG. 2 is a schematic view illustrating a frame structure of the infant supporting apparatus shown in FIG. 1.
Figure 3:
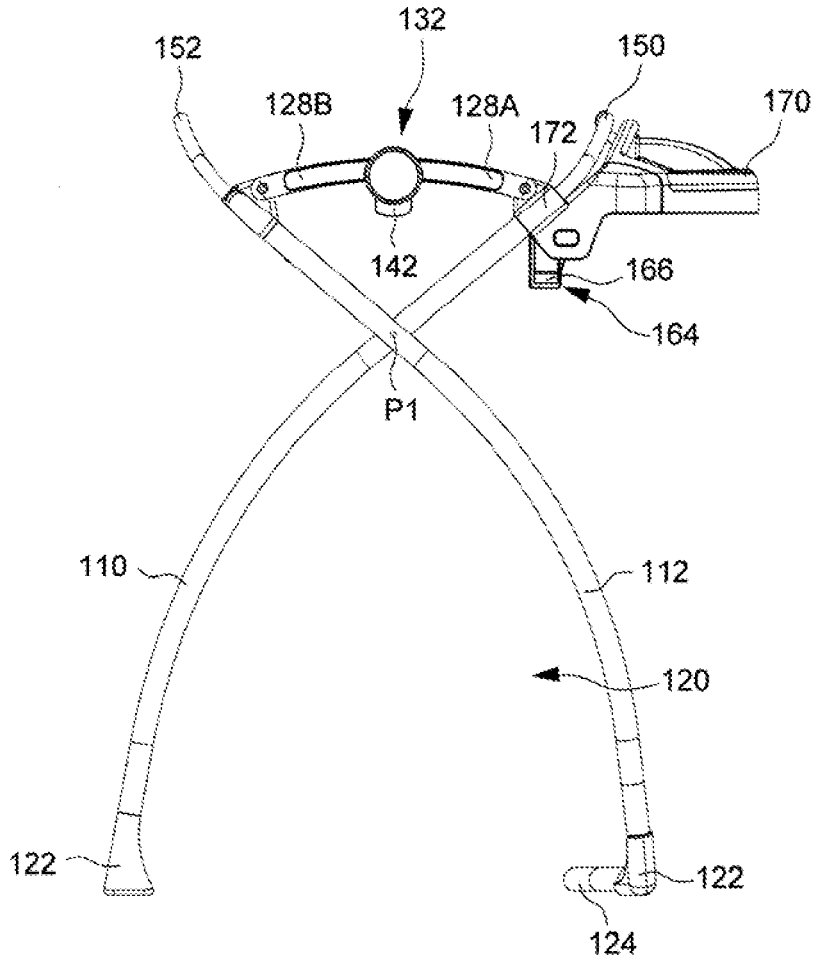
FIG. 3 is a side view illustrating the frame structure shown in FIG. 2.
Figure 4:
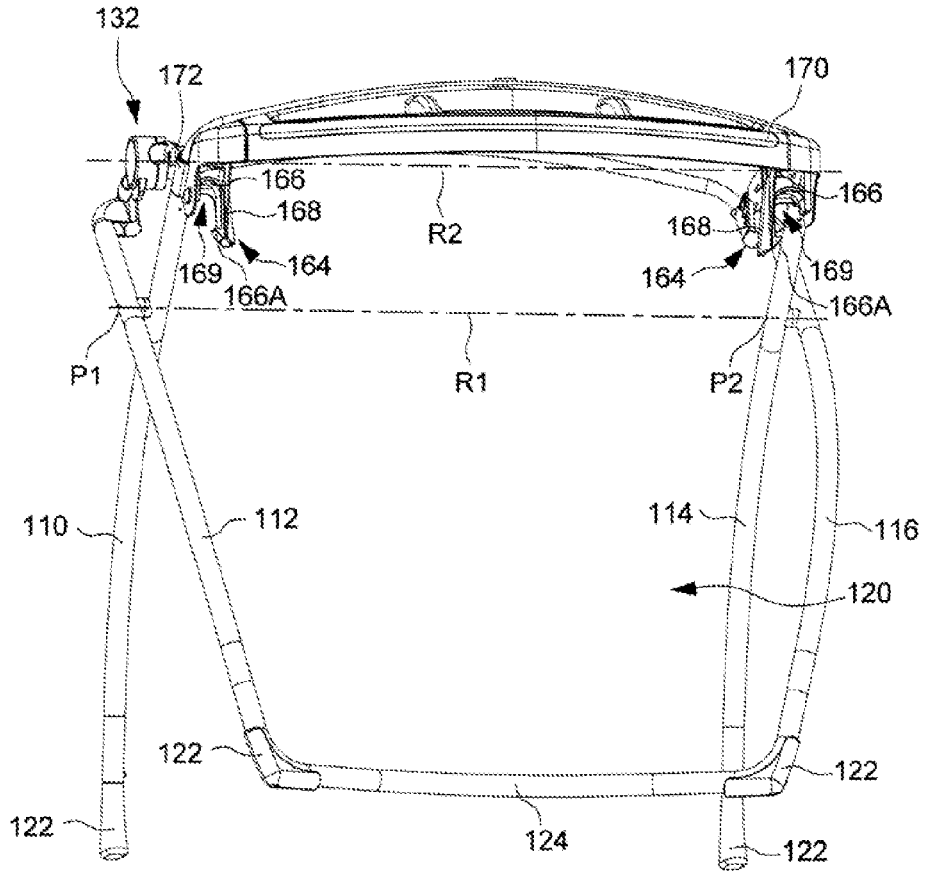
FIG. 4 is a schematic view illustrating the frame structure shown in FIG. 2 under another perspective.

Referring to FIGS. 2 and 3, the support frame 108 can be connected with the leg frame 106 above the foot portions 122. For example, the support frame 108 can be formed by two frame segments 150 and 152 parallel to each other, each frame segment having a tubular structure. The frame segment 150 can have two opposite ends respectively affixed with the upper ends of the legs 110 and 114, and the frame segment 152 can have two opposite ends respectively affixed with the upper ends of the legs 112 and 116. The frame segments 150 and 152 extend substantially parallel and along the same direction as the pivot axes R1 and R2.

The infant resting support 104 can be suspended from and extend between the frame segments 150 and 152 above the clearance 120. The infant resting support 104 can include a fabric, cushion and like soft material for comfortable contact with a child. In some embodiments, the infant resting support 104 may also include a rigid or resilient board (not shown) to provide better support for the child. As shown in FIG. 1, the infant resting support 104 can include lateral sidewall portions 156 and 158, and a bottom portion 160 between the sidewall portions 156 and 158. The sidewall portions 156 and 158 can be respectively assembled with the frame segments 150 and 152, so that the bottom portion 160 can be suspended from the support frame 108. Depending on the needs, the infant resting support 104 can be configured as a diaper changing platform, a bassinet or a napper station. For example, the sidewall portions 156 and 158 may have a smaller height and the bottom portion 160 may have a flat bearing surface to form a diaper changing platform, whereas the sidewall portions 156 and 158 can have a greater height to form a bassinet. When a child is placed on the bottom portion 160, the body of the child can be placed generally parallel to the direction of the pivot axis R1.

The infant supporting apparatus 100 can have two configurations of use. In FIG. 1, the infant supporting apparatus is shown in a first configuration in which the infant supporting apparatus 100 is used as an independent standalone structure that may be placed at any desirable location of a house.

Figure 5:
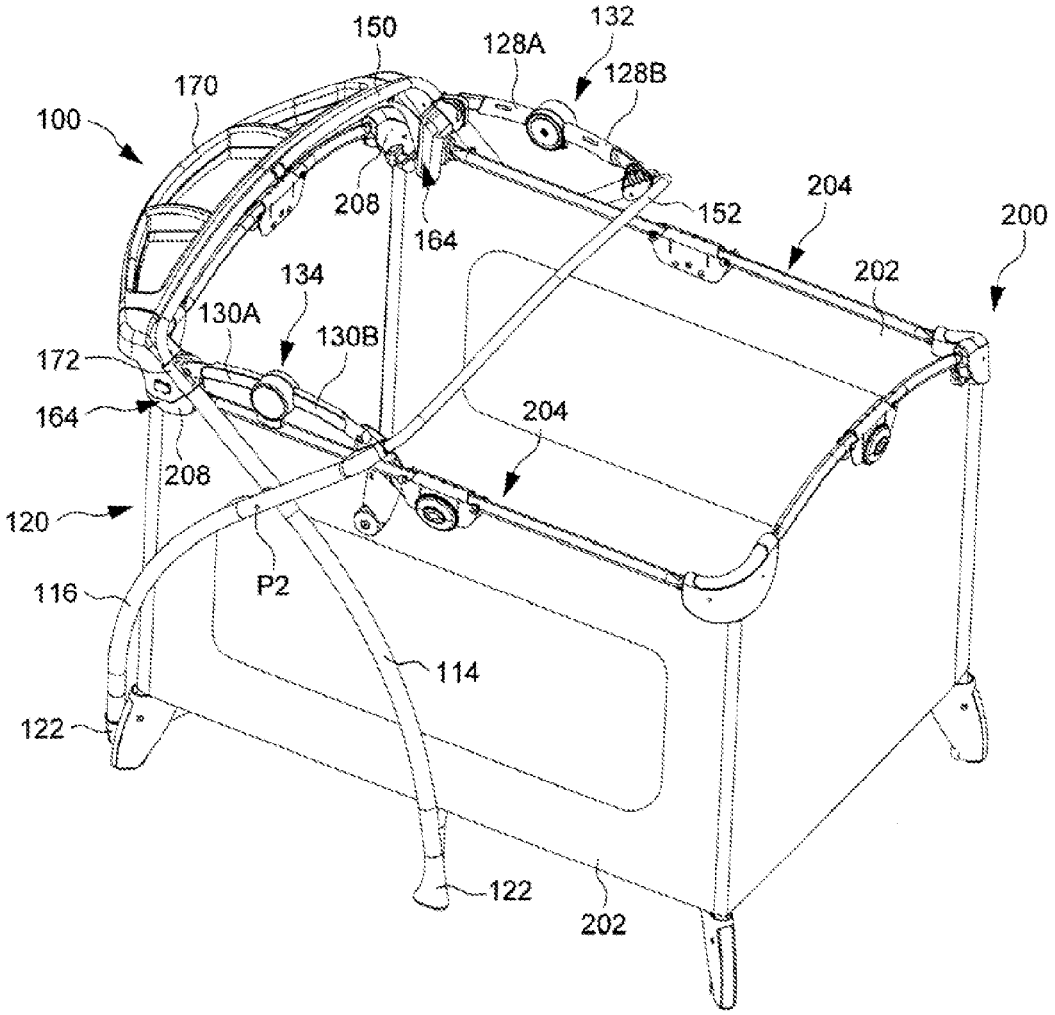
FIG. 5 is a schematic view illustrating the infant supporting apparatus shown in FIG. 1 used in combination with a play yard.
Figure 6:
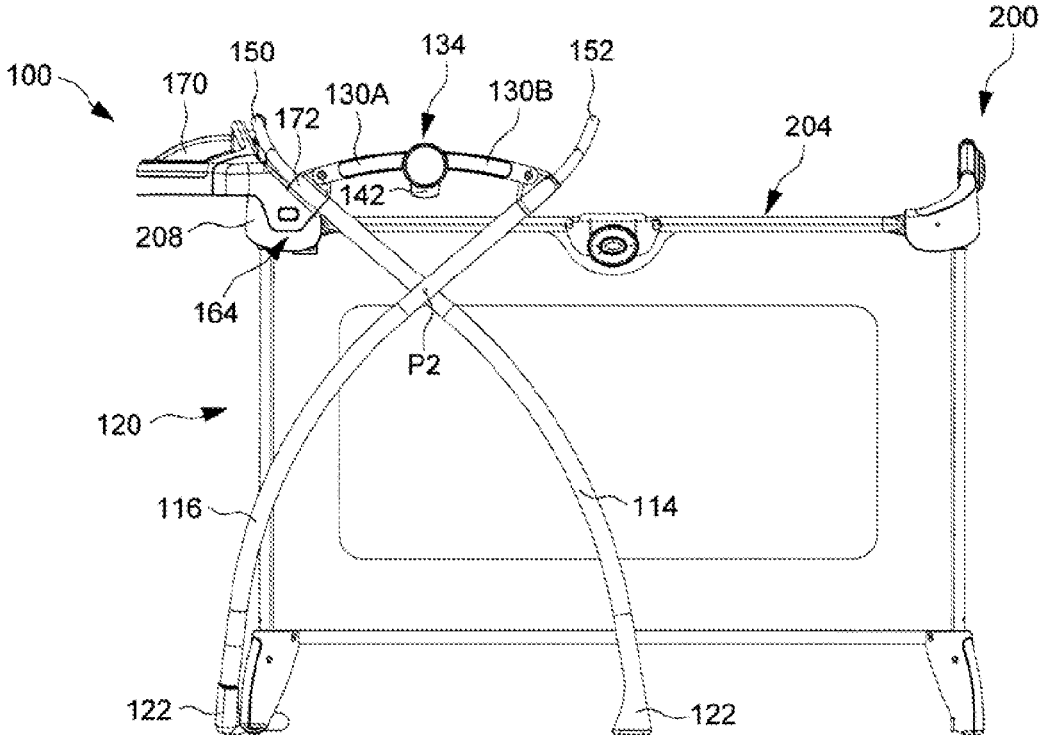
FIG. 6 is a side view illustrating the infant supporting apparatus used in combination with the play yard.

In FIGS. 5 and 6, the infant supporting apparatus 100 is shown in a second configuration in which the infant supporting apparatus 100 is used in combination with a play yard 200. For clarity, the representation of the infant resting support 104 is omitted in FIGS. 5 and 6. As shown in FIGS. 5 and 6, the leg frame 106 can stand on a ground surface, and the play yard 200 can be nested through the clearance 120 between the legs 110 and 112 at one side and the legs 114 and 116 at the other side, the infant supporting apparatus 100 being attached with the play yard 200. In this second configuration of use, the support frame 108 is located above two opposite upper hand rails 204 of the play yard 200 such that the infant resting support 104 (better shown in FIG. 1) can be suspended from above the play yard 200 and span across the interior space between two opposite upper hand rails 204 thereof. Moreover, the legs 110 and 112 and the legs 114 and 116 can lie adjacent to two opposite outer sidewalls 202 of the play yard 200, and the pivot links P1 and P2 are located at a lower height below the upper hand rails 204 for better stability. This allows the caregiver to conveniently use the infant supporting apparatus 100 in combination with the play yard 200 in a reduced space.

For facilitating the use of the infant supporting apparatus 100 with the play yard 200, a plurality of structural features may be provided to restrict displacement of the infant supporting apparatus 100 relative to the play yard 200. Referring to FIGS. 2-5, the infant supporting apparatus 100 can exemplary include one or more anchoring mount 164 configured to respectively mate with one or more corner joint of the play yard 200 that is positioned at least partially in the clearance 120, and a latching structure configured to engage with the play yard to attach the infant supporting structure 100 with the play yard. For example, the latching structure can include one or more latch 166 assembled with the leg frame 106 that can engage with and disengage from the play yard. In the illustrated embodiment, the infant supporting apparatus 100 is shown as exemplary including two anchoring mounts 164 and two latches 166.

The two anchoring mounts 164 can be respectively affixed with upper end portions of the legs 110 and 114 near the infant resting support 104 (better shown in FIG. 1). Each of the anchoring mounts 164 can be formed as a housing 168 having a recess 169 that is affixed with the leg 110 or 114.

Each latch 166 can be assembled with one corresponding anchoring mount 164 adjacent to the recess 169. For example, the latch 166 can be formed as a resilient part that is assembled in the housing 168, and has a catch portion 166A at a lower end portion.

When the play yard 200 is positioned through the clearance 120, the two anchoring mounts 164 can respectively mate with two opposite upper hand rails 204 of the play yard 200 for restricting displacement of the infant supporting apparatus 100 relative to the play yard 200. In particular, two corner joints 208 of the upper hand rails 204 of the play yard 200 can be respectively received at least partially in the recesses 169 of the housings 168, which can restrict displacement of the infant supporting apparatus 100 in a direction parallel to the pivot axis R1 relative to the play yard 200. Moreover, the latches 166 can resiliently engage with the two corner joints 208 to lock the infant supporting apparatus 100 with the play yard 200, the catch portions 166A respectively engaging with lower edges of the corner joints 208. The locking engagement of the latches 166 can prevent upward displacement of the infant supporting apparatus 100 in a direction perpendicular to the pivot axis R1 relative to the play yard 200.

In one embodiment, the infant supporting apparatus 100 can further include an organizer tray 170 disposed adjacent to the infant resting support 104. For example, two coupling brackets 172 can be respectively affixed with upper end portions of the legs 110 and 114, and the organizer tray 170 can be fixedly secured with the coupling brackets 172 and extend along the frame segment 150. In one embodiment, the anchoring mounts 164 can be respectively affixed with the coupling brackets 172 for a compact arrangement.

Figure 7:
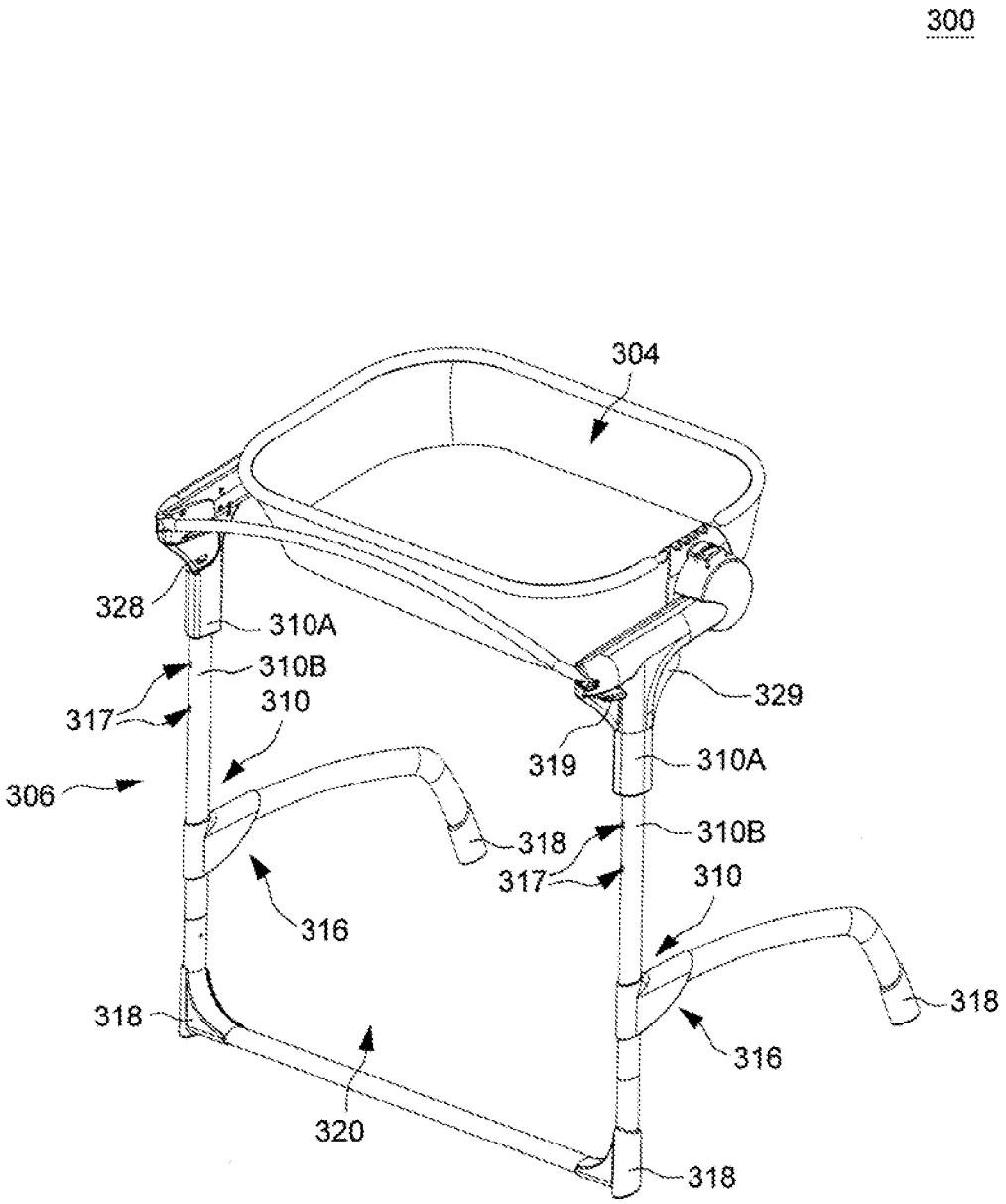
FIG. 7 is a schematic view illustrating a variant embodiment of an infant supporting apparatus.

FIG. 7 is a schematic view illustrating a variant embodiment of an infant supporting apparatus 300 that can be used as an independent standalone device or in combination with a play yard. Compared to the embodiment described previously, the infant supporting apparatus 300 can have a different leg frame 306. In this embodiment, the leg frame 306 can include two upright legs 310 between which is defined a clearance 320. Upper ends of the legs 310 can be provided with an infant resting support 304 held above the clearance 320. Each of the legs 310 can include a divergent structure 316, and foot portions 318 can be arranged at lower ends of the divergent structures 316 and the legs 310 for providing stable support on a ground surface. Moreover, each of the two legs 310 can be formed by two tube segments 310A and 310B telescopically assembled together. A height adjustment mechanism may also be assembled with each of the leg 310. The height adjusting mechanism can exemplary include an inner latch (not shown) that is assembled through an interior of the tube segment 310A and can engage with any of a plurality of lock openings 317 formed through the tube segment 310B to lock the tube segments 310A and 310B with each other, or disengage from the lock openings 317 to unlock the tube segments 310A and 310B so that they are movable relative to each other to modify a height of the infant resting support 304 above the foot portions 318. A release actuator 319 may be operatively connected with the inner latch of the height adjustment mechanism to facilitate unlocking operation.

Like previously described, each of the two legs 310 can have an upper end portion respectively provided with a latching structure 328 that can engage with a play yard (e.g., a corner joint thereof) while the play yard is nested through the clearance 320. The latching structure 328 may be connected with a release actuator 329 operable to unlock the latching structure 328.

Figure 8:
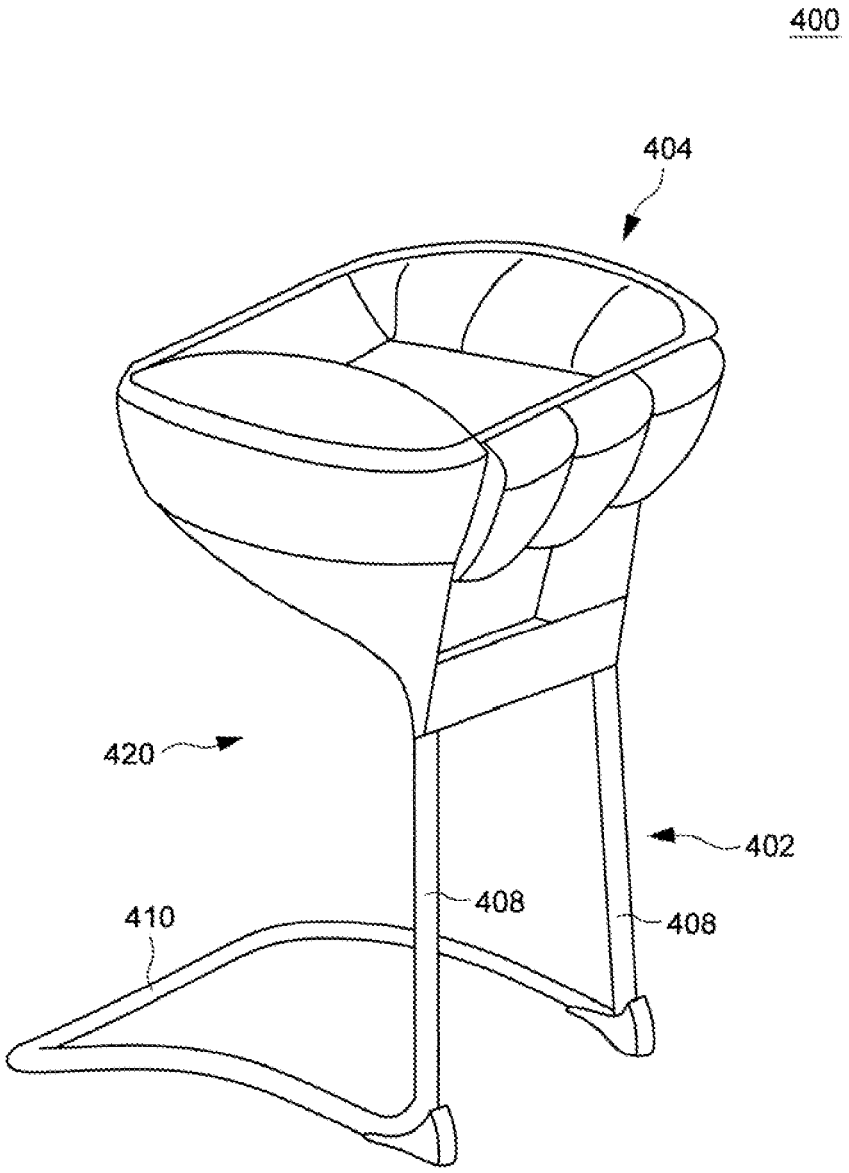
FIG. 8 is a schematic view illustrating another embodiment of an infant supporting apparatus.

FIG. 8 is a schematic view illustrating another embodiment of an infant supporting apparatus 400 that can be used as an independent standalone device or in combination with a play yard. The infant supporting apparatus 400 can include a leg frame 402, and an infant resting support 404 assembled with an upper portion of the leg frame 402. As shown, the leg frame 402 can include two upright legs 408 spaced apart from each other. A lower portion of the legs 408 can be connected with a base 410 that defines foot portions to provide stable support on a ground surface. A clearance 420 can be defined between the base 410 and the infant resting support 404. When the infant supporting apparatus 400 is used in combination with a play yard, the base 410 can rest on the ground surface and under a bottom of the play yard, and the leg frame 402 can lie adjacent to a sidewall of the play yard so as to hold the infant resting support 404 from above the play yard.

FIGS. 9-13 are schematic view illustrating another embodiment of an infant supporting apparatus 500 that can be used as an independent standalone device or in combination with a play yard. The infant supporting apparatus 500 can include a leg frame 502, a support frame 504 pivotally connected with the leg frame 502, and an infant resting support 506 (shown with phantom lines) assembled with the support frame 504. The leg frame 502 can include upright legs 512 between which is defined a clearance 520. Each of the legs 512 can include a divergent structure 516, and foot portions 518 can be arranged at lower ends of the legs 512 and the divergent structure 516 for providing stable support on a ground surface. The leg frame 502 can further include a transversal bar 522 that is fixedly joined with upper ends of the legs 512, and two sockets 524 respectively provided on the divergent structures 516.

The support frame 504 can be pivotally assembled with the transversal bar 522 of the leg frame 502, and the infant resting support 506 can be fixedly assembled with the support frame 504. In one embodiment, the support frame 504 can be formed as tubular frame having a closed shape.

Figure 10:
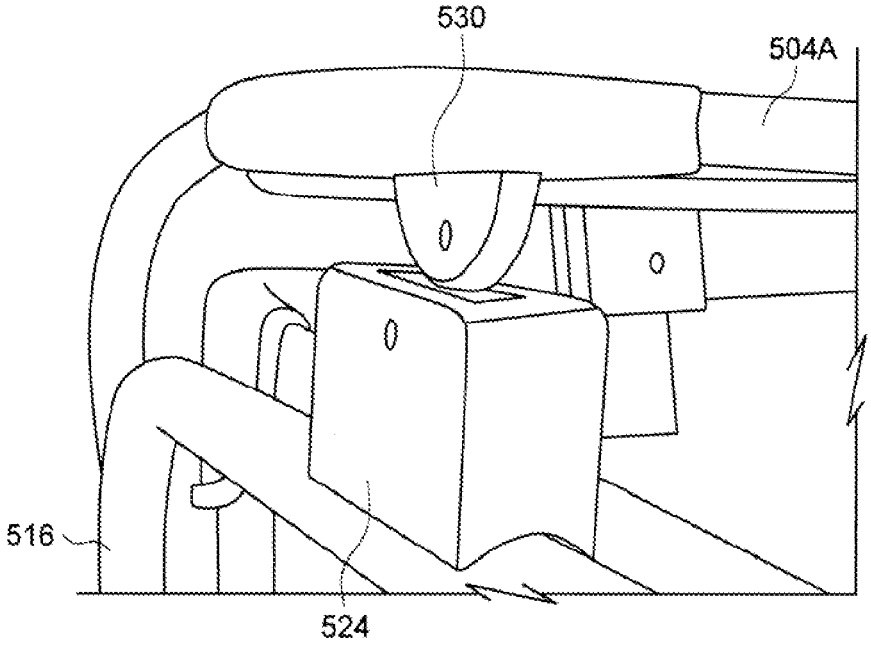
FIG. 10 is a schematic view illustrating a latching mechanism operable to lock the infant supporting apparatus shown in FIG. 9 in a use configuration.

Referring to FIG. 10, the support frame 504 can have two opposite side segments 504A respectively provided with two latches 530 configured to engage with the sockets 524. When the latches 530 are respectively disengaged from the sockets 524, the support frame 504 and the infant resting support 506 can rotate in unison about the transversal bar 522. When the latches 530 respectively engage with the sockets 524, the support frame 504 can be locked in a use configuration where the support frame 504 extend along a horizontal plane for suspending the infant resting support 506 above the clearance 520.

Referring again to FIG. 9, the infant supporting apparatus 500 can further include a storage tray 532 affixed with the leg frame 502 side-by-side relative to the support frame 504.

Figure 9:
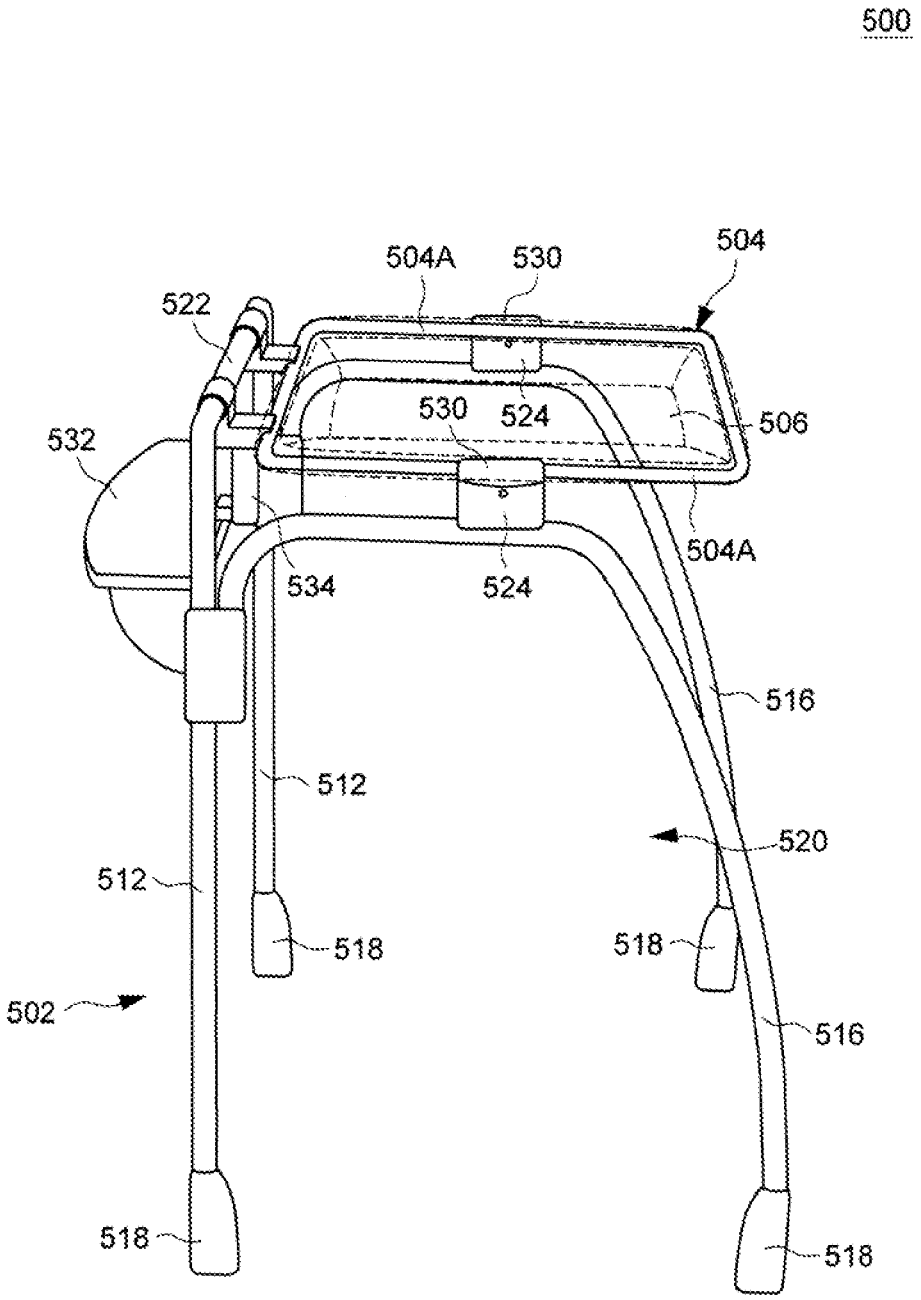
FIG. 9 is a schematic view illustrating yet another embodiment of an infant supporting apparatus.
Figure 11:
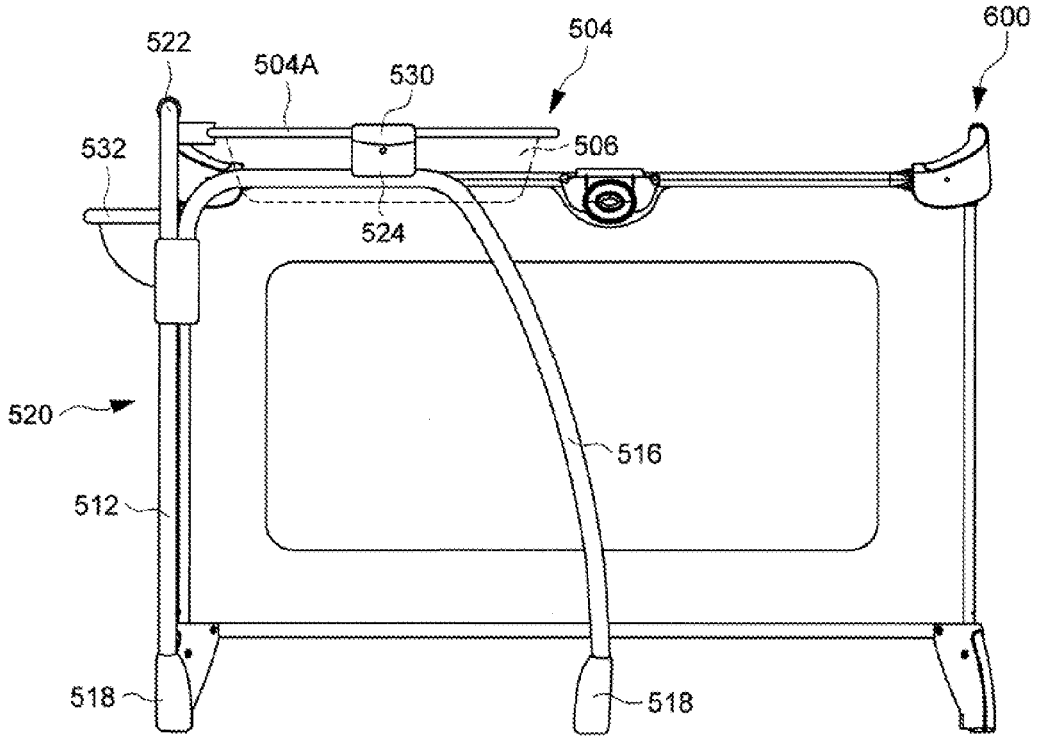
FIG. 11 is a schematic view illustrating the infant supporting apparatus of FIG. 9 used in combination with a play yard.
Figure 12:
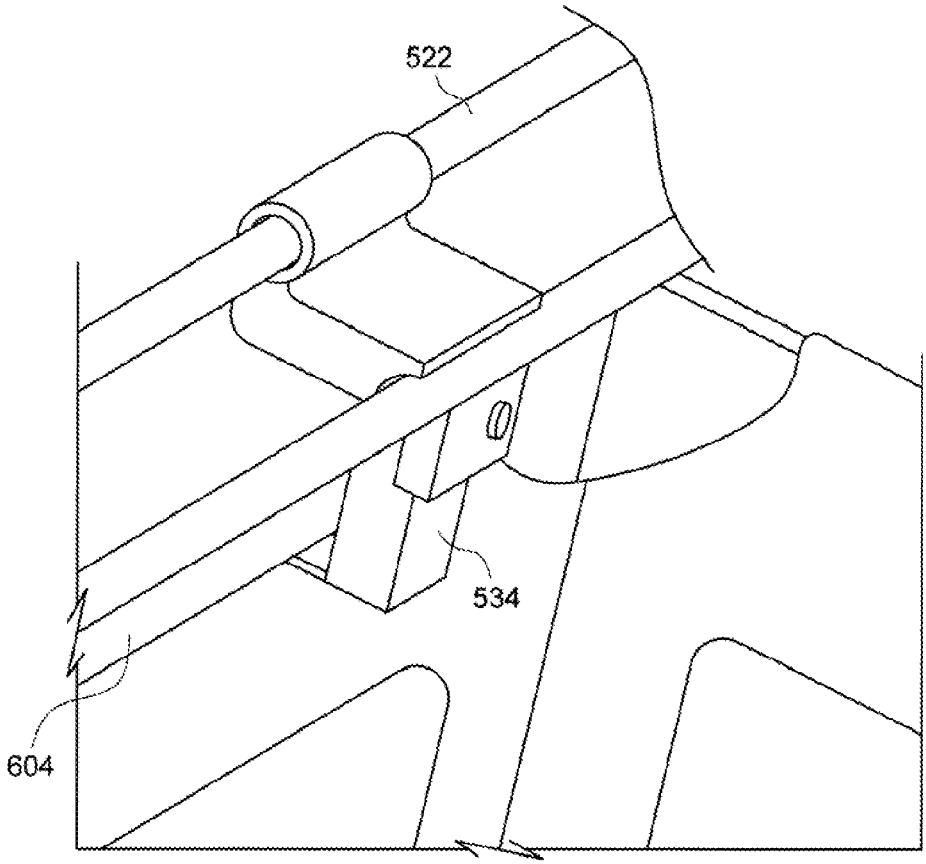
FIG. 12 is a schematic view illustrating a latching mechanism for locking the infant supporting apparatus shown in FIG. 9 with the play yard.

When the support frame 504 is locked in the use configuration, the infant supporting apparatus 500 can be used as a standalone device as shown in FIG. 9, or in combination with a play yard 600 that is nested through the clearance 520 as shown in FIG. 11. While the play yard 600 is nested through the clearance 520, the infant supporting apparatus 500 can also include a latching structure that can engage with the play yard 600. Referring to FIG. 12, the latching structure can exemplary include one or more latches 534 fixedly assembled with the support frame 504. The latches 534 can engage with an upper hand rail 604 of the play yard 600 while the play yard 600 is nested through the clearance 520. The latches 534 may be provided on the support frame 504 near the transversal bar 522 of the leg frame 502.

Figure 13:
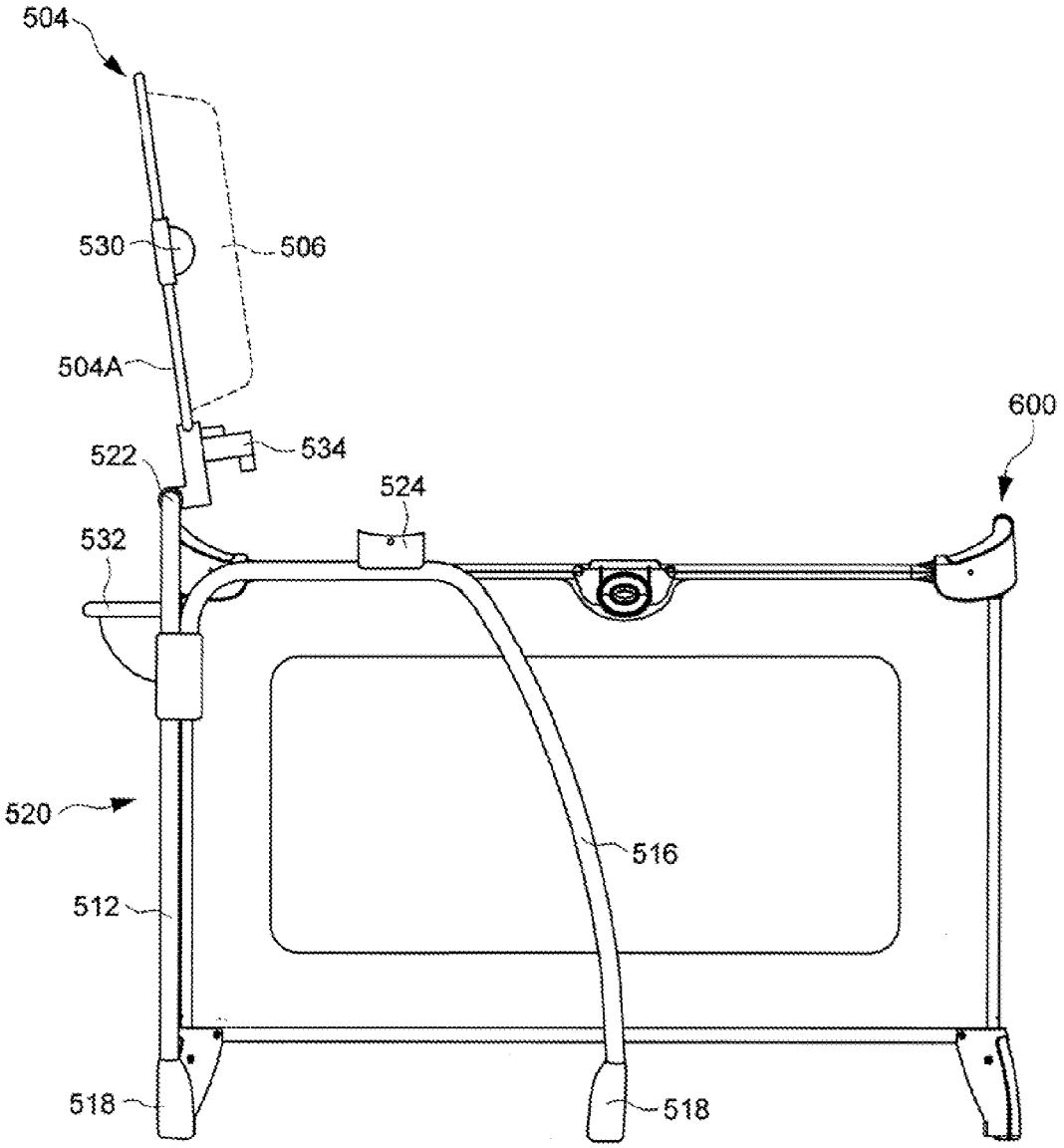
FIG. 13 is a schematic view illustrating the infant supporting apparatus of FIG. 9 with the infant resting support turned to an unused state.

Referring to FIG. 13, when the infant resting support 506 is unused, the latches 530 can be respectively disengaged from the sockets 524, and the support frame 504 and the infant resting support 506 then can be rotated relative to the leg frame 502 away from the interior of the play yard 600 for full access to the interior of the play yard 600. While it is rotated away from the interior of the play yard 600, the support frame 504 can drive the latches 534 to disengage from the upper hand rail 604 of the play yard 600 for facilitating removal of the infant supporting apparatus 500 from the play yard 600. When the infant supporting apparatus 500 is to be used in combination with the play yard 600, the play yard 600 can be nested through the clearance 520, and the support frame 504 can be rotated toward the interior of the play yard 600 so as to drive the latches 534 to come into locking engagement with the upper hand rail 604 of the play yard 600.

Advantages of the structures described herein include the ability to provide infant supporting apparatuses that can be used independently as standalone devices or in combination with a play yard. The infant supporting apparatus includes a leg frame having a clearance through which a play yard can nest for saving space. Moreover, the leg frame can independently stand on a ground surface to hold an infant resting support in suspension above the clearance at an elevated height, so that the infant supporting apparatus can be used separately from the play yard.

Realizations of the infant supporting apparatus have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant supporting apparatus comprising:

a leg frame having foot portions configured to provide support on a floor surface, the leg frame defining a clearance;

a support frame connected with the leg frame above the foot portions;

an infant resting support for receiving the placement of a child, the infant resting support being suspended from the support frame above the clearance; and a latching structure configured to engage with a play yard to attach the infant supporting apparatus with the play yard;

wherein the infant supporting apparatus entirely stands alone on a floor surface.

2. The infant supporting apparatus according to claim 1, wherein the latching structure is assembled with any of the leg frame and the support frame.

3. The infant supporting apparatus according to claim 1, wherein the latching structure is operable to engage with a play yard while the play yard is positioned through the clearance.

4. The infant supporting apparatus according to claim 1, wherein the latching structure is operable to engage with a corner joint of an upper hand rail of a play yard, while the play yard is positioned through the clearance.

5. The infant supporting apparatus according to claim 1, wherein the leg frame includes a first and a second leg pivotally connected with each other about a pivot axis, and a third and a fourth leg pivotally connected with each other about the same pivot axis.

6. The infant supporting apparatus according to claim 5, wherein the clearance is defined between a first side of the leg frame where the first and second legs are located, and a second side of the leg frame where the third and fourth legs are located.

7. The infant supporting apparatus according to claim 5, wherein the support frame is assembled with upper ends of the first through fourth legs.

8. The infant supporting apparatus according to claim 5, wherein the leg frame further includes a first and a second linkage segment, the first linkage segment has a first and a second end, the second linkage segment has a third and a fourth end, the first and fourth ends of the first and second linkage segments being respectively connected pivotally with the first and second legs, and the second and third ends of the first and second linkage segments being connected with each other about a pivot joint, the pivot joint being located above the pivot axis when the infant supporting apparatus is standing on the foot portions.

9. The infant supporting apparatus according to claim 1, wherein the leg frame includes two legs, each of the two legs having an upper end portion respectively assembled with an anchoring mount, the anchoring mount of each of the two legs being configured to mate with a corner joint at an upper hand rail of a play yard while the play yard is nested through the clearance.

10. The infant supporting apparatus according to claim 9, wherein at least one anchoring mount includes a housing, and the latching structure is assembled with the housing.

11. The infant supporting apparatus according to claim 9, wherein the clearance is defined between the two legs, and the infant supporting apparatus is usable in combination with a play yard that is positioned through the clearance between the two legs, the infant resting support being suspended from above the play yard.

12. The infant supporting apparatus according to claim 1, wherein the leg frame has a structure operable to adjust a height of the infant resting support above the foot portions.

13. The infant supporting apparatus according to claim 1, wherein the support frame and the infant resting support are operable to rotate in unison relative to the leg frame.

14. The infant supporting apparatus according to claim 1, wherein when a play yard is positioned through the clearance, the support frame is located above upper hand rails of the play yard.

15. The infant supporting apparatus according to claim 1, wherein the infant resting support is configured as a diaper changing platform, a bassinet or a napper station.

16. An infant supporting apparatus comprising:

a leg frame having foot portions configured to stand on a floor surface, the leg frame defining a clearance;

a support frame assembled with the leg frame above the foot portions; and an infant resting support for receiving the placement of a child, the infant resting support being suspended from the support frame above the clearance;

wherein the infant supporting apparatus has a configuration of use in which the infant supporting apparatus has the leg frame standing on a floor surface adjacent to a play yard that is received at least partially through the clearance, the infant supporting apparatus standing on the floor surface independently from the play yard, the infant resting support being suspended from above the play yard and the infant supporting apparatus being attached with the play yard.

17. The infant supporting apparatus according to claim 16, wherein the leg frame includes two legs, when a play yard is positioned through the clearance, the two legs stand on a floor surface adjacent to two opposite outer sidewalls of the play yard.

18. The infant supporting apparatus according to claim 16, further including at least one anchoring mount disposed near the infant resting support, when a play yard is received in the clearance, the anchoring mount being configured to mate with a portion of an upper hand rail of the play yard for restricting displacement of the infant supporting apparatus relative to the play yard.

19. The infant supporting apparatus according to claim 18, wherein the anchoring mount is assembled with a latch operable to engage with a play yard to attach the infant support apparatus with the play yard.

20. The infant supporting apparatus according to claim 19, wherein the anchoring mount of each of the two legs being configured to mate with a corner joint of an upper hand rail of a play yard while the play yard is positioned at least partially in the clearance, and the latch is operable to engage with the corner joint.

21. The infant supporting apparatus according to claim 16, wherein the support frame is assembled with a latch operable to engage with an upper hand rail of a play yard.

22. The infant supporting apparatus according to claim 16, wherein the leg frame includes a first and a second leg pivotally connected with each other about a pivot axis, and a third and a fourth leg pivotally connected with each other about the same pivot axis, the clearance being defined between the first and second legs at a first side, and the third and fourth legs at a second side opposite to the first side.

23. The infant supporting apparatus according to claim 22, wherein the support frame includes a first and a second frame segment, the first frame segment being respectively connected with the first and third legs, and the second frame segment being connected with the second and fourth legs.

24. The infant supporting apparatus according to claim 22, wherein the leg frame further includes a first and a second linkage segment, the first linkage segment has a first and a second end, the second linkage segment has a third and a fourth end, the first and fourth ends of the first and second linkage segments being respectively connected pivotally with the first and second legs, and the second and third ends of the first and second linkage segments being connected with each other about a pivot joint, the pivot joint being located above the pivot axis when the infant supporting apparatus is standing on the foot portions.

25. The infant supporting apparatus according to claim 16, wherein the infant resting support is configured as a diaper changing platform, a bassinet, or a napper station.

26. The infant supporting apparatus according to claim 16, wherein the leg frame has a structure operable to adjust a height of the infant resting support above the foot portions.

27. The infant supporting apparatus according to claim 16, wherein the support frame and the infant resting support are operable to rotate in unison relative to the leg frame.

28. The infant supporting apparatus according to claim 16, wherein when a play yard is positioned through the clearance, the support frame is located above an upper hand rail of the play yard.

* * * * *